US009966035B2

(12) United States Patent
Kim et al.

(10) Patent No.: US 9,966,035 B2
(45) Date of Patent: May 8, 2018

(54) ORGANIC LIGHT EMITTING DISPLAY DEVICE AND DRIVING METHOD THEREOF

(71) Applicant: LG Display Co., Ltd., Seoul (KR)

(72) Inventors: Chang-Man Kim, Daegu (KR); Do Wan Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 55 days.

(21) Appl. No.: 14/586,527

(22) Filed: Dec. 30, 2014

(65) Prior Publication Data

US 2015/0187328 A1 Jul. 2, 2015

(30) Foreign Application Priority Data

Dec. 31, 2013 (KR) ..... 10-2013-0169459

(51) Int. Cl.
*G09G 3/30* (2006.01)
*G09G 5/02* (2006.01)
(Continued)

(52) U.S. Cl.
CPC ..... *G09G 5/02* (2013.01); *G09G 3/3208* (2013.01); *G09G 3/3225* (2013.01); *G09G 3/2003* (2013.01); *G09G 3/3291* (2013.01); *G09G 2320/0242* (2013.01); *G09G 2320/0295* (2013.01); *G09G 2320/043* (2013.01); *G09G 2340/02* (2013.01); *G09G 2360/16* (2013.01); *G09G 2360/18* (2013.01)

(58) Field of Classification Search
CPC ..... G09G 5/02; G09G 3/32; G09G 3/3208; G09G 3/3225; G09G 3/2003; G09G 3/3291; G09G 2360/16; G09G 2360/18; G09G 2320/0295; G09G 2320/043; G09G 2320/0242; G09G 2340/02; H04N 19/136
USPC ..... 345/76–83
See application file for complete search history.

(56) References Cited

U.S. PATENT DOCUMENTS 5,046,119 A * 9/1991 Hoffert ..... G06T 9/005 358/524
5,712,659 A 1/1998 Adachi
(Continued)

FOREIGN PATENT DOCUMENTS

CN 1212806 A 3/1999
CN 1536874 A 10/2004
(Continued)

*Primary Examiner* — Jimmy H Nguyen
(74) *Attorney, Agent, or Firm* — Birch, Stewart, Kolasch & Birch, LLP

(57) ABSTRACT

Discussed is an organic light emitting display device and a driving method thereof, which reduce a size of corrected image data by using a color compression scheme to decrease a capacity of a memory, and reduce a size of an integrated circuit (IC) to increase a manufacturing yield. The method can include loading a compensation coefficient stored in a memory, correcting image data by applying the compensation coefficient to a data voltage supplied to a pixel, compressing, in different compression schemes, corrected image data of a color having high visual perceivability and corrected image data of a color having low visual perceivability, and synthesizing corrected image data of red, green, and blue pixels, which are compressed by the different compression schemes, to store the synthesized image data in a memory.

3 Claims, 6 Drawing Sheets

(51) Int. Cl.

| | |
|---|---|
| ***G09G 3/3208*** | (2016.01) |
| ***G09G 3/3225*** | (2016.01) |
| *G09G 3/20* | (2006.01) |
| *G09G 3/3291* | (2016.01) |

(56) References Cited

U.S. PATENT DOCUMENTS 5,815,097 A * 9/1998 Schwartz ..... H03M 7/30 341/51
6,031,572 A 2/2000 Christopoulos
6,044,180 A 3/2000 Brandestini et al.
7,551,787 B2 * 6/2009 Marks ..... G06T 9/00 382/239
2001/0041011 A1 * 11/2001 Passaggio ..... H04N 19/503 382/232
2002/0191854 A1 12/2002 Kakarala et al.
2004/0165780 A1 8/2004 Maki et al.
2008/0094330 A1 4/2008 Sun et al.
2010/0157159 A1 6/2010 Kim et al.
2012/0229664 A1 * 9/2012 Solomon ..... H04N 5/23229 348/222.1
2013/0301890 A1 * 11/2013 Kaempfer ..... H04N 19/172 382/131
2013/0321664 A1 * 12/2013 Jung ..... H04N 5/238 348/229.1
2013/0342550 A1 * 12/2013 Yang ..... H04N 19/172 345/531
2014/0099025 A1 * 4/2014 Suzuki ..... H04N 19/597 382/166

FOREIGN PATENT DOCUMENTS

CN 101442673 A 5/2009
CN 101764924 A 6/2010
CN 102088604 A 6/2011
CN 102761738 A 10/2012

* cited by examiner

FIG. 2
(RELATED ART)

< Raw compensation data >

| | | | | | | | | | | | | | | | |
|---|---|---|---|---|---|---|---|---|---|---|---|---|---|---|---|
| 03 | FE | 0E | 00 | 03 | F4 | 0E | 00 | 01 | 0A | 0A | 00 | 0B | 00 | 0A | 00 |
| FF | 0A | 0A | 00 | FF | 00 | 0A | 00 | FB | FC | 06 | 00 | FB | FC | 06 | 00 |
| FF | 00 | 0A | 00 | FF | 00 | 0A | 00 | FB | 02 | 09 | 00 | FB | F8 | FF | 00 |
| F9 | 02 | 0A | 00 | 03 | 02 | 0A | 00 | F9 | 06 | 0E | 00 | 03 | FC | 0E | 00 |
| F9 | FE | 0A | 00 | 03 | FE | 0A | 00 | FC | FE | 05 | 00 | 01 | 03 | 0A | 00 |
| F9 | 06 | 0A | 00 | 03 | FC | 0A | 00 | FF | 06 | 0A | 00 | FF | FC | 0A | |
| FF | 02 | 0A | 00 | FF | F8 | 0A | 00 | FF | 06 | 07 | 00 | FF | FC | 11 | 00 |
| F9 | FE | 06 | 00 | 03 | FE | 06 | 00 | 03 | 02 | 0A | 00 | 03 | 02 | 0A | 00 |

< Compensation data lost after application of compression >

| | | | | | | | | | | | | | | | |
|---|---|---|---|---|---|---|---|---|---|---|---|---|---|---|---|
| F9 | 02 | OA | 00 | 03 | 02 | 00 | 00 | FF | 05 | 10 | 00 | 04 | F0 | 0F | 00 |
| FE | FF | 08 | 00 | 04 | FC | 09 | 00 | FC | FE | 07 | 00 | 02 | 04 | 0C | 00 |
| F0 | 05 | 0B | 00 | 07 | FC | 09 | 00 | FF | 05 | 08 | 00 | FF | FA | 0C | 00 |
| F0 | 02 | 09 | 00 | 01 | F9 | 0C | 00 | FF | 05 | 0A | 00 | FC | 00 | 0F | 00 |
| FA | FE | 0A | 00 | 02 | F0 | 06 | 00 | 02 | 00 | 0C | 00 | 01 | 03 | 0A | 00 |
| FF | FE | 0B | 00 | 00 | FE | 0B | 00 | FB | FC | 06 | 00 | 04 | 00 | 0B | 00 |
| 00 | 03 | 07 | 00 | 00 | FF | 0C | 00 | F8 | 03 | 09 | 00 | 09 | 03 | 0C | 00 |
| FA | FE | 10 | 00 | 00 | F0 | 11 | 00 | FF | 04 | 06 | 00 | FF | FF | 0C | 00 |

ORGANIC LIGHT EMITTING DISPLAY DEVICE AND DRIVING METHOD THEREOF

CROSS-REFERENCE TO RELATED APPLICATIONS

This application claims the priority benefit of the Korean Patent Application No. 10-2013-0169459 filed on Dec. 31, 2013, which is hereby incorporated by reference as if fully set forth herein.

BACKGROUND OF THE INVENTION

Field of the Invention

The present invention relates to an organic light emitting display device, and more particularly, to an organic light emitting display device and a driving method thereof, which reduce a size of corrected image data by using a color compression scheme to decrease a capacity of a memory, and reduce a size of an integrated circuit (IC) to increase a manufacturing yield.

Discussion of the Related Art

Recently, organic light emitting devices, which self-emit light without a separate light source and have better viewing angle, brightness, and contrast than those of LCD devices are attracting much interest. Also, since the organic light emitting display devices do not use a backlight, the organic light emitting display device are manufactured to be light and thin, and have low power consumption and a fast response time.

In the organic light emitting display devices, a characteristic of each pixel is changed depending on a driving time and a temperature. Here, a compensation scheme is categorized into an internal compensation scheme and an external compensation scheme depending on a position of a compensation circuit that compensates for a characteristic change of pixels. The internal compensation scheme is a scheme in which a compensation circuit is disposed inside each of the pixels. The external compensation scheme is a scheme in which the compensation circuit is disposed outside each pixel.

Threshold voltages (Vth) and mobility (k) of driving thin film transistors (TFTs) of pixels differ due to a deviation of a process of manufacturing the driving TFTs (DT). For this reason, in general organic light emitting display devices, despite the same data voltage (Vdata) being applied to the driving TFT (DT) of each pixel, a uniform quality of an image cannot be realized due to a deviation of a current flowing in an organic light emitting diode (OLED).

To solve such problems, a threshold voltage change and mobility change of the driving TFT of each pixel are sensed. Subsequently, the threshold voltage change and mobility change of the driving TFT are compensated based on sensing values. Therefore, a driving voltage "k*Vdata+Vth" obtained by summating a data voltage (Vdata) based on an image signal and a compensation voltage (Vth, k) is supplied to a gate of the driving TFT.

FIG. 1 is a diagram illustrating a method of generating corrected image data in a related art organic light emitting display device, and FIG. 2 is a diagram illustrating raw compensation data and after-compression loss-corrected data according to a related art.

Referring to FIGS. 1 and 2, the related art organic light emitting display device loads compensation coefficients for red, green, and blue pixels from an external memory 1, and corrects image data of the red, green, and blue pixels by using the compensation coefficients.

A compression encoder 2 compresses image data which is corrected by a lossy or lossless compression scheme, and the compressed and corrected image data is stored in a static random access memory (SRAM) 3.

A compression decoder 4 loads the corrected image data stored in the SRAM 3, and decodes the compensated image data.

An external compensation unit 5 performs a pixel compensation operation by using the corrected image data to compensate for mura of an OLED panel.

The related art organic light emitting display device uses the same compression encoder and decoder so as to enable the compression encoder and the compression decoder to be easily designed. Generally, a compression of an image is performed by one selected from the lossy compression scheme and the lossless compression scheme depending on a memory size. The lossy compression scheme analyzes a pattern of an image. A method, which removes a high frequency component (which is not perceived by a viewer well) to decrease a size of whole image data, is applied to the related art organic light emitting display device.

In regard to a characteristic of the OLED panel, a compensation coefficient is random data, and thus, when lossy compression is applied to a stored compensation coefficient, a noise component is perceived by a viewer due to a loss error which occurs after compression when a method of reducing a high frequency component is used.

In the lossless compression scheme, a compression rate is greatly lowered, and thus, random data has a compression rate of less than 1.8:1. Therefore, a large-capacity memory of 50 Mbyte or more is needed with respect to a full-HD resolution (1920*1080).

In general image data, a noise component is not easily perceived despite application of the lossy compression scheme. However, in data independent from a screen pattern like a compensation coefficient, a noise component is perceived by applying the lossy compression scheme.

In particular, a mobile display device is limited in size, and for this reason, it is limited to enlarge a capacity of a memory storing compensated image data. On the other hand, when a compression rate of data is low, it is difficult to produce goods.

SUMMARY OF THE INVENTION

Accordingly, the present invention is directed to provide an organic light emitting display device and a driving method thereof that substantially obviate one or more problems due to limitations and disadvantages of the related art.

An aspect of the present invention is directed to provide an organic light emitting display device and a driving method thereof, which reduce a size of corrected image data to decrease a capacity of a memory.

Another aspect of the present invention is directed to provide an organic light emitting display device and a driving method thereof, which reduce a size of a memory storing corrected image data to increase a manufacturing yield.

In addition to the above-mentioned objects of the present invention, other features and advantages of the present invention will be described below, but will be clearly understood by those skilled in the art from descriptions below.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a method of driving an organic light emitting display device including: loading a compensation coefficient stored in a memory; correcting image data by applying the compensation coefficient to a data voltage supplied to a pixel; compressing, in different compression schemes, corrected image data of a color having high visual perceivability and corrected image data of a color having low visual perceivability; and synthesizing corrected image data of red, green, and blue pixels, which are compressed by the different compression schemes, to store the synthesized image data in a memory.

The method may further include: compressing the corrected image data of the color having high visual perceivability in a lossless compression scheme; and compressing the corrected image data of the color having low visual perceivability in a lossy compression scheme.

The corrected image data of the red pixel may be compressed by the lossless compression scheme. The corrected image data of the green pixel may be compressed by the lossless compression scheme. The corrected image data of the blue pixel may be compressed by the lossy compression scheme.

A storage space of the memory may be checked, and when the storage space of the memory is equal to or greater than a certain size, the lossless compression scheme may be applied to compression of the corrected image data of the color having low visual perceivability.

The corrected image data of the blue pixel may be compressed by the lossless compression scheme.

When the lossy compression scheme is applied, the same error value may be applied to image data by using bit shift.

The corrected image data of the blue pixel may be compressed by using average data of adjacent pixels.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 2 is a diagram illustrating raw compensation data and after-compression loss-corrected data according to a related art;

DETAILED DESCRIPTION OF THE INVENTION

Figure 1:
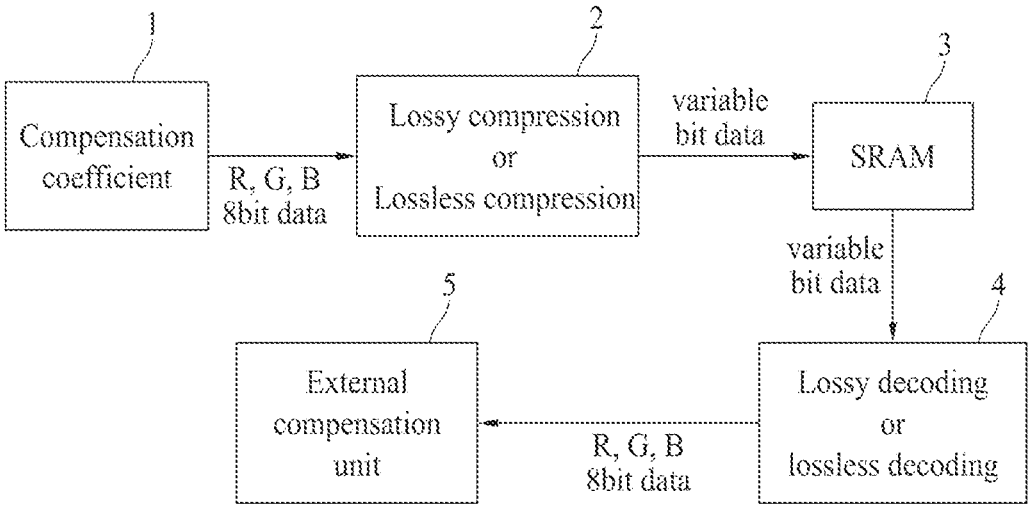
FIG. 1 (RELATED ART)
FIG. 1 is a diagram illustrating a method of generating corrected image data in a related art organic light emitting display device.

Reference will now be made in detail to the exemplary embodiments of the present invention, examples of which are illustrated in the accompanying drawings. Wherever possible, the same reference numbers will be used throughout the drawings to refer to the same or like parts.

In the specification, in adding reference numerals for elements in each drawing, it should be noted that like reference numerals already used to denote like elements in other drawings are used for elements wherever possible.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It should be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Before providing a description with reference to the drawings, a structure of a plurality of pixels formed in an OLED panel and an external compensation scheme will be described, and then, an organic light emitting display device and a driving method thereof according to an embodiment of the present invention will be described.

A plurality of gate lines GL, a plurality of sensing signal lines SL, a plurality of data lines DL, a plurality of driving power lines PL, and a plurality of reference power lines RL are formed in an OLED panel. A plurality of pixels are defined by intersections between the plurality of gate lines GL and the plurality of data lines DL.

Each of the plurality of pixels includes an OLED and a pixel circuit PC that emits light from the OLED.

The plurality of gate lines GL and the plurality of sensing signal lines SL may be formed in parallel in a first direction (for example, a horizontal direction) in the OLED panel. In this case, a scan signal (a gate driving signal) is applied from a gate driver to the plurality of gate lines GL. A sensing signal is applied from the gate driver to the plurality of sensing signal lines SL.

The plurality of data lines DL may be formed in a second direction (for example, a vertical direction) in the OLED panel. The plurality of data lines DL may be formed to intersect the plurality of gate lines GL and the plurality of sensing signal lines SL.

A driving voltage VDD is supplied from a data driver to the data line DL. Here, the driving voltage VDD is a voltage obtained by summating a data voltage (Vdata) based on an image signal and a compensation voltage (Vth, k) for compensating for a characteristic change of a driving TFT.

A characteristic (a threshold voltage (Vth) and mobility (k)) of the driving TFT may be compensated for in real time by using compensation data at a power-on time when the organic light emitting display device is powered on or in a driving section where an image is displayed. Also, the characteristic (the threshold voltage (Vth) and the mobility (k)) of the driving TFT may be compensated for at a power-off time when the organic light emitting display device is powered off.

The plurality of reference power lines RL are formed in parallel with the plurality of data lines DL. A display reference voltage (Vref) may be selectively supplied from the data driver to the reference power lines RL. In this case, the display reference voltage (Vref) is supplied to the reference power line RL during a data charging period of each pixel P.

A digital-to-analog converter (DAC) of the data driver supplies the driving voltage VDD, obtained by summating the data voltage (Vdata) based on the image signal and the compensation voltage (Vth, k), to the data line of each pixel. In this case, the driving voltage VDD has a voltage level obtained by adding a compensation voltage, corresponding to the characteristic change (the threshold voltage (Vth) and the mobility (k)) of the driving TFT (DT) of a corresponding pixel P, to the data voltage (Vdata).

The organic light emitting display device according to an embodiment of the present invention senses characteristics of all the pixels to compensate for mura of the OLED panel before a product is released by a manufacturer. Also, even after the product is released, the organic light emitting display device according to an embodiment of the present invention senses the characteristics of all the pixels to compensate for the mura of the OLED panel.

Figure 3:
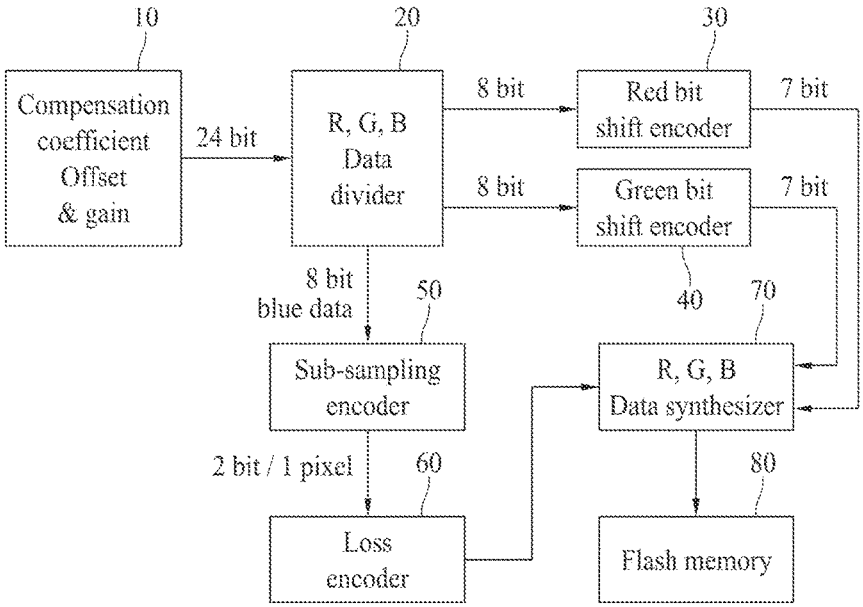
FIG. 3 illustrates an organic light emitting display device according to an embodiment of the present invention, and is a diagram illustrating a method of compressing and storing compensation data which is corrected before a product is released.

FIG. 3 illustrates an organic light emitting display device according to an embodiment of the present invention, and is a diagram illustrating a method of compressing and storing compensation data which is corrected before a product is released.

Referring to FIG. 3, the organic light emitting display device according to an embodiment of the present invention includes a data divider 20, a plurality of bit shift encoders 30 and 40, a sub-sampling encoder 50, a loss encoder 60, a data synthesizer 70, and a flash memory 80.

The data divider 20 loads compensation coefficients for red, green, and blue pixels from an external memory 10, and corrects image data of the red, green, and blue pixels by using the compensation coefficients.

Subsequently, the data divider 20 compresses the corrected image data of the red, green, and blue pixels in different compression schemes that are color compression schemes.

For example, different compression schemes are respectively applied to corrected image data of a color having high visual perceivability and corrected image data of a color having low visual perceivability.

The corrected image data of the color having high visual perceivability is compressed by a lossless compression scheme. The corrected image data of the color having low visual perceivability is compressed by a lossy compression scheme.

The image data of the red and green pixels have high visual perceivability, and thus, the lossless compression scheme is applied thereto.

A first bit shift encoder 30 compresses the corrected image data of the red pixel in the lossless compression scheme. A second bit shift encoder 40 compresses the corrected image data of the green pixel in the lossless compression scheme. Here, the first and second bit shift encoders 30 and 40 may perform lossless compression.

The corrected image of the red pixel and the corrected image data of the green pixel are compressed to 7-bit data by removing a bit, which has the lowest weight on data, from 8-bit data in a least significant bit (LSB) scheme.

A bit shift compression scheme uses a method that regards the LSB as 0 in 7 bits. Also, in 6.4 bits, the bit shift compression scheme groups three pieces of data into one to process the three pieces of data as the same data, thereby reducing a data capacity.

The corrected image data of the blue pixel has low visual perceivability, and thus, the lossy compression scheme is applied thereto.

Figure 4:
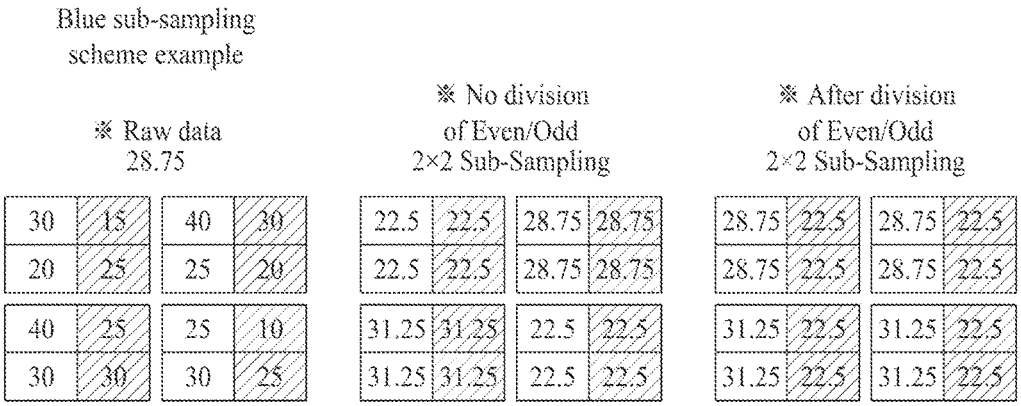
FIG. 4 is a diagram illustrating that corrected image data of a blue pixel is compressed by a lossy compression scheme, in a method of driving the organic light emitting display device according to an embodiment of the present invention.

FIG. 4 is a diagram illustrating that corrected image data of a blue pixel is compressed by a lossy compression scheme, in a method of driving the organic light emitting display device according to an embodiment of the present invention.

Referring to FIG. 4, the sub-sampling encoder 50 receives corrected 8-bit image data of a blue pixel, and samples the corrected image data of the blue pixel in a sub-sampling scheme. Then, the loss encoder 60 compresses 8-bit raw data to 2-bit compression data.

In this case, the sub-sampling encoder 50 may divide data into even data and odd data, and perform sub-sampling in a 2*2 type. As another example, the sub-sampling encoder 50 may perform the sub-sampling in a 2*2 type without dividing the data into the even data and the odd data.

Here, when the lossy compression scheme is applied, the same error value is applied to image data by using bit shift. The corrected image data of the blue pixel may be compressed by using average data of adjacent pixels.

Subsequently, the data synthesizer 70 loads corrected image data of a red pixel and corrected image data of a green pixel, which are compressed by the lossless compression scheme.

Moreover, the data synthesizer 70 loads the corrected image data of the blue pixel compressed by the lossy compression scheme.

Subsequently, the data synthesizer 70 stores the corrected image data of the red, green, and blue pixels, in which a data capacity is reduced through compression, in the flash memory 80.

However, the present invention is not limited thereto. For example, a storage space of the flash memory 80 may be checked, and when the storage space of the flash memory 80 is sufficient to more than a certain size, the lossless compression scheme may be applied to compression of corrected image data of a color having low visual perceivability. That is, the lossless compression scheme may be applied in compressing the corrected image data of the blue pixel having low visual perceivability.

Here, a JPEG-LS compression scheme is applied to the corrected image data of the green pixel and the corrected image data of the red pixel. Furthermore, by applying the sub-sampling compression scheme to the corrected image data of the blue pixel, a total compression rate is 2.5:1.

Figure 5:
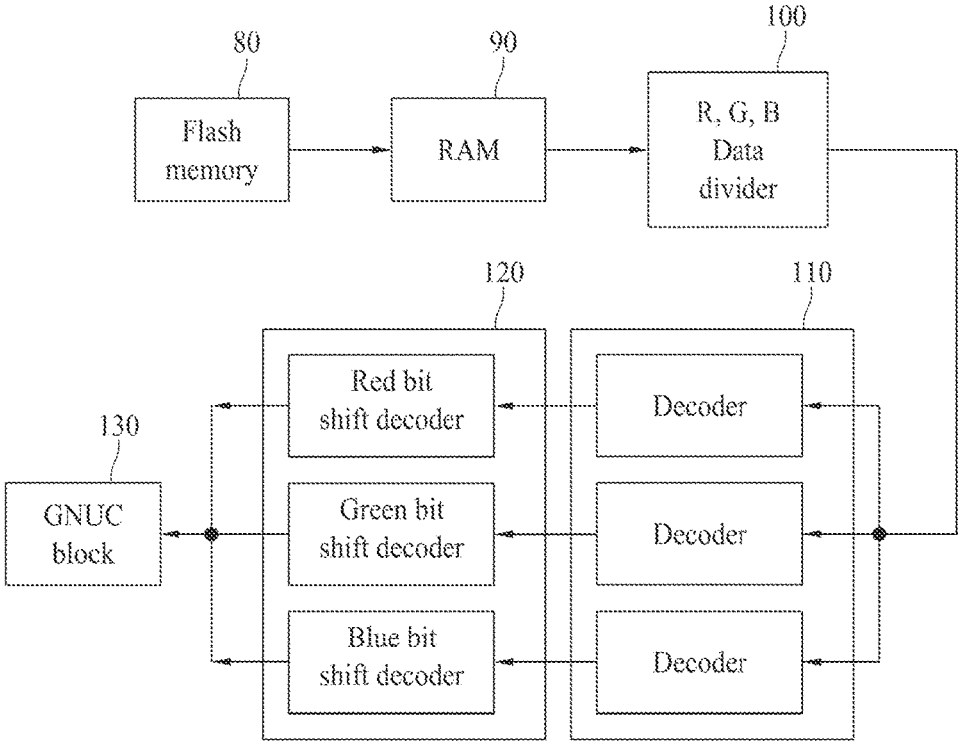
FIG. 5 illustrates an organic light emitting display device according to an embodiment of the present invention, and is a diagram illustrating that compensation data, which is corrected in a data driver after a product is released, is decoded, and applied to compensation driving.

FIG. 5 illustrates an organic light emitting display device according to an embodiment of the present invention, and is a diagram illustrating that compensation data, which is corrected in a data driver after a product is released, is decoded, and applied to compensation driving.

Referring to FIG. 5, the organic light emitting display device according to an embodiment of the present invention includes a random access memory (RAM) 90, a data divider 100, a decoder 110, a lossless decoder 120, and a compensation driver 130, for decoding corrected image data which is compressed and stored in a flash memory 80 and performing a pixel compensation operation.

Corrected image data of red, green, and blue pixels, which are compressed and stored in the flash memory 80, are loaded into the RAM 90.

Subsequently, the data divider 100 loads the corrected image data of the red, green, and blue pixels from the RAM 90. Then, the data diver 100 separates, by color, the corrected image data of the red, green, and blue pixels.

Subsequently, the decoder 110 decodes the corrected image data of the blue pixel which is compressed by the lossy compression scheme.

The lossless decoder 120 decodes the corrected image data of the red and green pixels which are compressed by the lossless compression scheme.

Subsequently, the compensation driver 130 compensates for all the pixels of the OLED panel by using the decoded and corrected image data of the red, green, and blue pixels. Therefore, mura of the OLED panel is compensated for.

Figure 6:
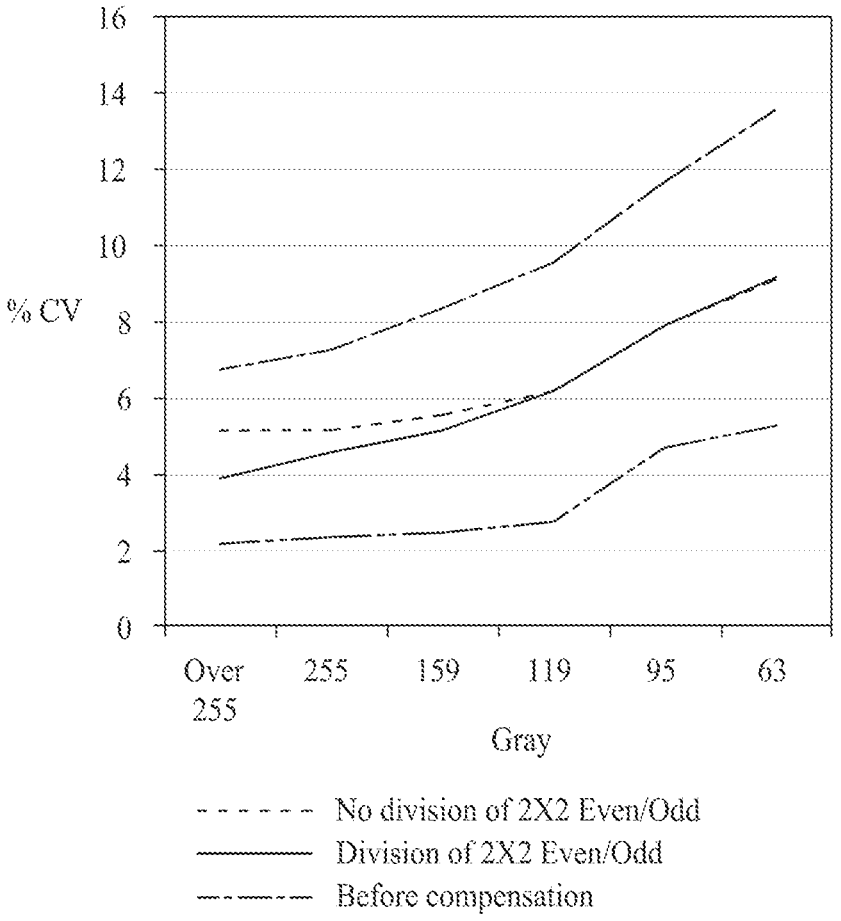
FIG. 6 is a diagram showing that a mura level increases in even/odd separation in a sub-sampling scheme.
Figure 7:
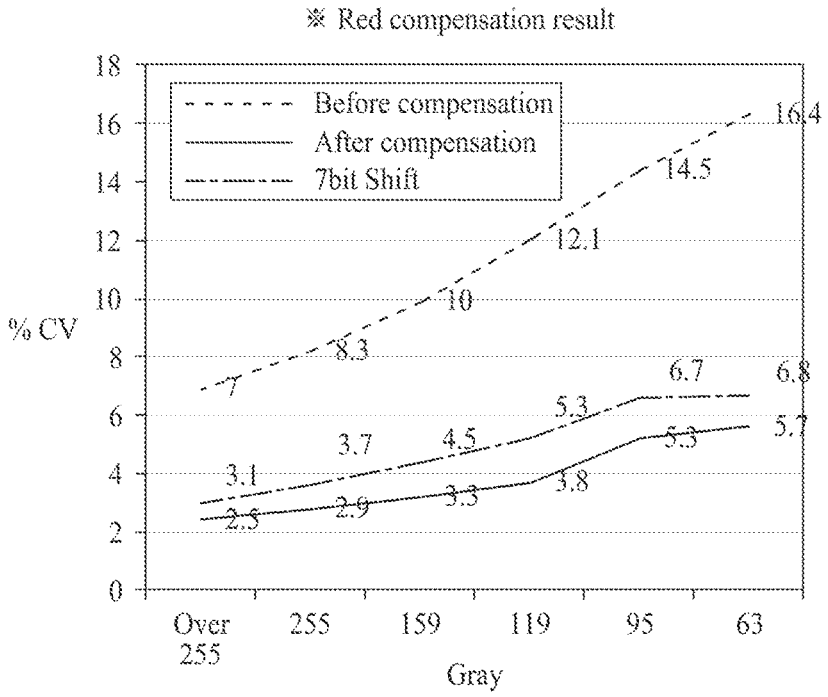
FIG. 7 is diagrams showing results of pixel compensations which are performed by using corrected image data of a red pixel and a green pixel which are compressed by a lossless compressions scheme according to an example of the present invention.
Figure 7:
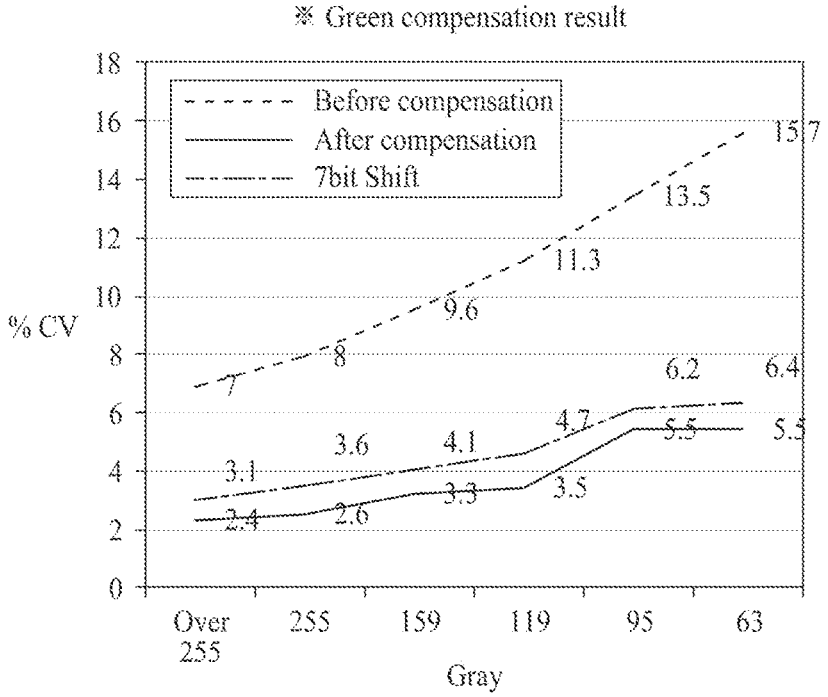

FIG. 6 is a diagram showing that a mura level increases in even/odd separation in a sub-sampling scheme. FIG. 7 is diagrams showing results of pixel compensations which are performed by using corrected image data of a red pixel and a green pixel which are compressed by a lossless compressions scheme.

Referring to FIGS. 6 and 7, in applying the sub-sampling scheme, when even data and odd data are separated from each other, a CV value decreases, but mura perceived by eyes increases. In a gray image, an image expressed in gray is applied by lowering a chroma of corrected image data of a blue pixel so as to increase a visibility of mura.

In performing sub-sampling compression, a difference of CV values based on the presence of even/odd separation is caused by a sensing difference between even data and odd data in raw data of an image. Even data and odd data are divided, and then, when 2×2 sub-sampling is performed, a deviation of lines is reduced.

When compensation is performed after 7-bit shift compression, a CV value increases by about 1% in all gray scales of a red pixel and green pixel.

A result of the 7-bit shift compression is slightly perceived, but is allowable. According to a quantitative evaluation result, a CV value increases progressively closer to a low gray scale. In a case of perceived noise, it can be seen that the noise is the most greatly perceived in a gray scale of 127, and is slightly perceived in a low gray scale.

As described above, the organic light emitting display device and the driving method thereof according to the embodiments of the present invention reduce a size of corrected image data to decrease a capacity of a memory.

Moreover, the organic light emitting display device and the driving method thereof according to the embodiments of the present invention reduce a size of a memory storing corrected image data to increase a manufacturing yield.

Moreover, the organic light emitting display device and the driving method thereof according to the embodiments of the present invention reduce a size of a memory to reduce the manufacturing cost.

Moreover, the organic light emitting display device and the driving method thereof according to the embodiments of the present invention reduce a size of a memory, thereby enabling an IC to be easily designed.

In the organic light emitting display device and the driving method thereof according to the embodiments of the present invention, when a memory IC is manufactured in a chip-on glass (COG) type, an area of a chip-on film (COF) adhered to a panel is reduced, there decreasing a bezel size.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of driving an organic light emitting display device including a memory, the method comprising:

dividing, using a data divider, image data into image data of red pixels, image data of green pixels, and image data of blue pixels;

loading, from an external memory, a compensation coefficient stored in the external memory to the data divider;

individually correcting the image data of red pixels, the image data of green pixels, and the image data of blue pixels, using the data divider, by individually applying the corresponding loaded compensation coefficient to the image data of the red pixels, the image data of green pixels, and the image data of blue pixels;

in response to an available empty space of the memory being more than a predetermined size, applying a lossless compression scheme to the corrected image data of red pixels, the corrected image data of green pixels, and the corrected image data of blue pixels to generate a first set of corrected and compressed image data and storing the first set of corrected and compressed image data in the memory of the organic light emitting display device; and in response to the available empty space of the memory being less than the predetermined size, dividing the corrected image data of blue pixels into even-column corrected image data of blue pixels and odd-column corrected image data of blue pixels and separately applying a 2×2 matrix type sub-sampling scheme on each of plural 2×2 matrix of the even-column corrected image data of blue pixels and each of plural 2×2 matrix of odd-column corrected image data of blue pixels to generate sub-sampled and corrected image data of blue pixels, and applying the lossless compression scheme to the corrected image data of red pixels and the corrected image data of green pixels, and applying a lossy compression scheme to the sub-sampled and corrected image data of blue pixels to generate a second set of corrected and compressed image data and storing the second set of corrected and compressed image data in the memory of the organic light emitting display device, wherein the second set of corrected and compressed image data has a higher rate of data compression and a smaller size than the first set of corrected and compressed image.

2. The method of claim 1, wherein the corrected image data of red pixels and the corrected image data of green pixels are compressed by removing least significant bit (LSB) from the corrected image data of red pixels and the corrected image data of green pixels.

3. The method of claim 1, wherein the corrected image data of blue pixels are sampled in a sub-sampling scheme before the compressing when the checked available empty space of the memory is lower than the predetermined value.

* * * * *